US005908353A

United States Patent [19]

Andrews

[11] Patent Number: 5,908,353

[45] Date of Patent: Jun. 1, 1999

[54] METHOD AND APPARATUS FOR PLAYING ROYAL CARD STUD POKER AND ROYAL CARD DRAW POKER GAMES

[76] Inventor: Douglas S. Andrews, 6168 Meadow View La., Las Vegas, Nev. 89103

[21] Appl. No.: 08/987,045

[22] Filed: Dec. 9, 1997

[51] Int. Cl.[6] ..... A63F 1/00

[52] U.S. Cl. ..... 463/13; 273/292

[58] Field of Search ..... 273/292, 274, 273/303, 304, 305, 306; 463/13

[56] References Cited

U.S. PATENT DOCUMENTS

| | | | |
|---|---|---|---|
| 4,440,398 | 4/1984 | Charon | 273/292 |
| 5,022,653 | 6/1991 | Suttle et al. | 463/13 |
| 5,356,140 | 10/1994 | Dabrowski et al. | 273/292 X |
| 5,411,257 | 5/1995 | Fulton | 463/13 |
| 5,437,451 | 8/1995 | Fulton | 273/292 X |

*Primary Examiner*—William E. Stoll
*Attorney, Agent, or Firm*—Philip D. Junkins

[57] ABSTRACT

A method and apparatus for playing, via an electronic video game machine, a player-versus-paytable five-card poker game utilizing the 20 royal cards of a standard 52-card poker deck as a royal deck of cards with player pay-off awards based upon predetermined amounts related to a paytable of winning five-card hands. Bet wagers are initially accepted by the game machine from the player. Where the royal card poker game is a draw poker game the game machine deals and displays five cards face-up on the machine's video screen. Where the poker game is a stud poker game the game machine deals and displays three or four cards face-up and one or two cards face-down. The player, after viewing the video displayed cards, is permitted to stand on the initial bet wager or double the bet wager. Where the game is draw poker, the player is then permitted to discard one or more cards and exchange the discarded cards for substitute machine dealt cards to complete the poker hand. Where the game is stud poker, the player is then permitted to turn up the one or two original face-down cards to complete the poker hand. The game machine then evaluates the player's completed royal card hand to determine whether or not the hand comprises a winning hand in accordance with the paytable of winning hands with game machine pay-off to the player for a winning hand.

10 Claims, 1 Drawing Sheet

Figure 2:
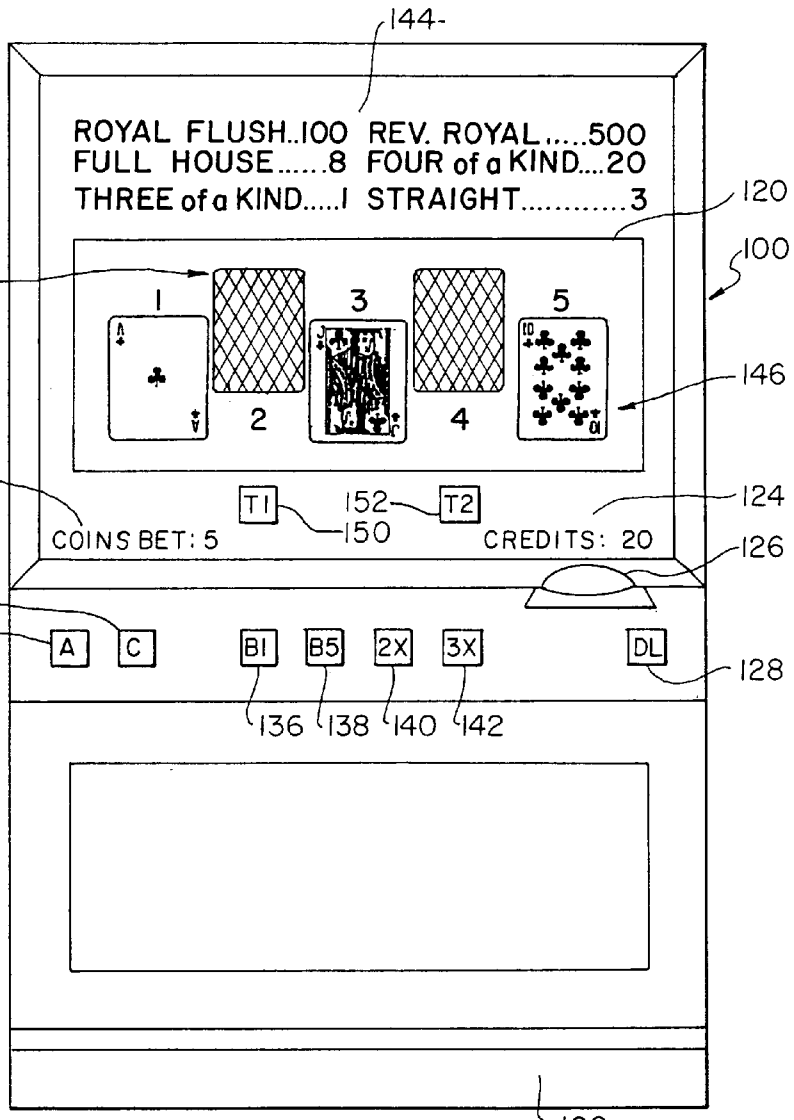

METHOD AND APPARATUS FOR PLAYING ROYAL CARD STUD POKER AND ROYAL CARD DRAW POKER GAMES

BACKGROUND OF THE INVENTION

The present invention relates to five-card draw poker and to five-card stud poker games and, more particularly, to five-card poker games played by an individual player on an electronic gaming machine that deals from a standard 52 card poker deck with the player placing a "bet" wager before being dealt (face-up) a five-card draw poker hand or a partial stud poker hand.

Where the machine game is five-card draw poker, the player thereupon evaluates his or her machine dealt cards with respect to the winning hand combinations set forth on the paytable of the machine and elects to hold the hand as dealt or to exchange (discard) one or more of the original cards of the five-card hand with replacement machine dealt cards. The draw poker machine then displays replacement cards for the cards the player has discarded. The player wins or loses the hand based upon conventional poker hand rankings for the resulting five-card hand. The paytable is established based upon the number of coins or tokens wagered by the player and the type of poker hand achieved by the player.

A typical paytable or payout schedule that is used in electronic video draw poker machines is set forth below:

PAYTABLE I.

| Coins or Tokens Deposited | 1 | 2 | 3 | 4 | 5 |
|---|---|---|---|---|---|
| Royal Flush | 250 | 500 | 750 | 1000 | 4000 |
| Straight Flush | 50 | 100 | 150 | 200 | 250 |
| Four of a Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 2 | 4 | 6 | 8 | 10 |
| Jacks or Better | 1 | 2 | 3 | 4 | 5 |

Where the machine game is five-card stud poker, the initial hand dealt to the player usually comprises four face-up cards and the player has the option of staying (standing on the initial "bet" wager) or betting additional coins or tokens (most stud poker machines allow only a doubling of the initial "bet" wager) to increase the amount of a winning payout when he or she receives the fifth card. After the fifth card is dealt to the player, the value of the five-card hand is determined based upon conventional poker hand rankings for his or her five-card hand. Again, the paytable is established based upon the number of coins or tokens wagered by the player and the type of poker hand achieved by the player. Paytable I. above may also apply to machine played five-card stud poker games except that a double payout may be achievable as indicated above.

Poker is one of the most exciting gambling games because it includes for each individual player a mix of skill, luck, and psychology. Throughout the world millions of players try their luck each year at the game of poker at card tables and at electronic gaming machines in gaming rooms and casinos.

Five-card draw poker at card tables is typically played in two basic formats, i.e., between players or between individual players and a house dealer. Many table-game players prefer a player-versus-player draw poker game because it involves the elements of inter-player skill and psychology, the latter element including a player's ability to bluff the strength of his or her hand versus the assumed strength of the hands of the other players. Many other table-game players prefer to play a "stud" form of poker at a standard gaming table against a house dealer or against a paytable of hands because such table game play tends to minimize the elements of skill and psychology with each player relying principally on luck.

There remains a need in the gaming room and casino businesses for new draw poker and stud poker type games which can be played on electronic video poker gaming machines and which provide an appropriate mix of the elements of player skill and luck along with a speed-up of game play time and the excitement of involving a multitude of royal card hands.

SUMMARY AND OBJECTS OF THE INVENTION

The present invention comprises apparatus and methodology for playing a new and related variety of draw poker and stud poker games on electronic video poker gaming machines in public and private gaming rooms and casinos. These new games are limited to the use of the four royal flush hands (twenty cards) available in a standard 52 card deck with the games being most suitable for a player-versus-paytable game format.

A preferred embodiment of the invention comprises a "royal card draw poker" video game, for an individual player, wherein the apparatus methodology comprises the steps of:

a) machine acceptance from the game player of an initial "bet" wager via a coin or token entry slot of the machine or from the player's machine credit bank;

b) machine random dealing and video, display of five cards face-up to the player from the electronic "royal card deck" of 20 cards comprised of all of the 10s, jacks, queens, kings and aces of a standard poker deck;

c) permitting the player, after viewing his or her five-card displayed hand, via appropriate machine control buttons, to either: stand on the initial "bet" wager, or double the "bet" wager;

d) permitting the player, after standing on or doubling the initial "bet" wager, via appropriate machine control buttons, to either: stand on the five-card hand as dealt, or exchange (discard) one or more of the original cards with replacement machine dealt cards;

e) machine random dealing from the remainder of the royal card deck and video display of replacement cards in a final five-card player's hand; and f) machine evaluation of the player's final five-card hand with respect to the paytable of winning hands for the royal card draw poker video game of the machine and pay-off to the player's machine credit bank of an appropriate amount of coins or tokens for a winning hand according to the paytable of winning hands as related to the number of coins or tokens wagered.

For the above preferred embodiment of the royal five-card draw video poker game of the invention the paytable may comprise:

PAYTABLE II.

| Coins or Tokens Deposited | 1 | 2 | 3 | 4 | 5 |
|---|---|---|---|---|---|
| Reversible Royal Flush | 500 | 1000 | 1500 | 2000 | 2500 |
| Royal Flush | 100 | 200 | 300 | 400 | 500 |
| Four of a Kind | 20 | 40 | 60 | 80 | 100 |
| Full House | 8 | 16 | 24 | 32 | 40 |
| Straight | 3 | 6 | 9 | 12 | 15 |
| Three of a Kind | 1 | 2 | 3 | 4 | 5 |

It is to be noted that there would be no differentiation of payoff odds for any four of a kind hands and the only flush combination of cards must comprise a royal flush since the number of cards utilized in the game is limited to the 20 cards forming the four royal card suites. It is also to be noted that where the player of the royal card draw poker game of the invention doubles his or her wager before replacement cards are dealt, the paytable pay-offs are doubled for winning hands.

A further preferred embodiment of the invention comprises a "royal card stud poker" video game, for an individual player, wherein the apparatus methodology comprises the steps of:

a) machine acceptance from the game player of an initial "bet" wager via a coin or token entry slot of the machine or from the player's machine credit bank;

b) machine random dealing and video display of three cards face-up to the player from the electronic "royal card deck" of 20 royal flush cards and two cards from the "royal card deck" face-down with the back side of such cards displayed to the player;

c) permitting the player, after viewing the three face-up cards of his or her five-card hand, via an appropriate machine control button, to either: stand on the initial "bet" wager, or double the initial "bet" wager;

d) permitting the player, after standing on or doubling the initial "bet" wager, via an appropriate machine control button, to turn-up one of the face-down cards:

e) permitting the player, after viewing the four face-up cards of his or her five-card hand, via an appropriate machine control button, to either: stand on the initial "bet" wager or doubled initial "bet" wager or triple the initial "bet" wager when he or she has previously doubled the initial "bet" wager;

f) permitting the player, after standing on the initial "bet" wager, doubled "bet" wager or tripled "bet" wager, via an appropriate machine control button, to turn-up the second of the face-down cards to complete the hand of five displayed cards; and g) machine evaluation of the player's final five-card hand with respect to the paytable of winning hands for the royal card stud poker video game of the machine and pay-off to the player's machine credit bank of an appropriate amount of coins or tokens for a winning hand according to the paytable of winning hands as related to the number of coins or tokens wagered.

For the above further preferred embodiment of the royal five-card stud video poker game of the invention the paytable may comprise a paytable like or similar to Paytable II. above. As in the case of the first preferred embodiment of the present royal card video poker game invention, there would be no differentiation of payoff odds for any four of a kind hands and the only flush combination of cards must comprise a royal flush. Further, it is to be noted that where the player of the royal card stud poker game of the invention doubles or triples his or her wager before turning up the second face-down card, the paytable pay-offs are doubled or tripled for winning hands.

Other variations of the basic royal five-card draw poker and royal five-card stud poker game apparatus and methodology of the present invention include the addition to the twenty cards comprising the four royal flush sets of a standard 52 card deck of cards a wild card such as a duce card or a joker card or any other low card (below a 10), in which cases the game win odds are slightly diminished.

It is a principal object of the present invention to provide a player-versus-paytable five-card draw poker video game and a player-versus-paytable stud poker video game for an individual gaming machine player, each game involving only the royal hand cards of a standard 52 card deck.

It is a further object of the invention to provide a player-versus-paytable five-card draw poker video game and a player-versus-paytable stud poker video game for an individual gaming machine player involving the 20 cards forming the four suits of royal cards of a standard 52 card deck and which involves an appropriate mix of the elements of player skill and luck with a speed-up of game play time and the excitement of obtaining a royal flush or reversible royal flush as a high payoff hand.

It is a still further object of the invention to provide a video gaming machine apparatus which displays royal card poker games that encourage a high amount of individual player interest while maintaining acceptable payback percentages.

It is yet another object of the invention to provide methodology for playing royal card draw poker and royal card stud poker games wherein the player may have the opportunity of doubling or doubling and tripling the player's original bet and wherein the games encourage a high amount of individual player interest while maintaining acceptable payback percentages.

BRIEF DESCRIPTION OF THE DRAWING FIGURES

Figure 1:
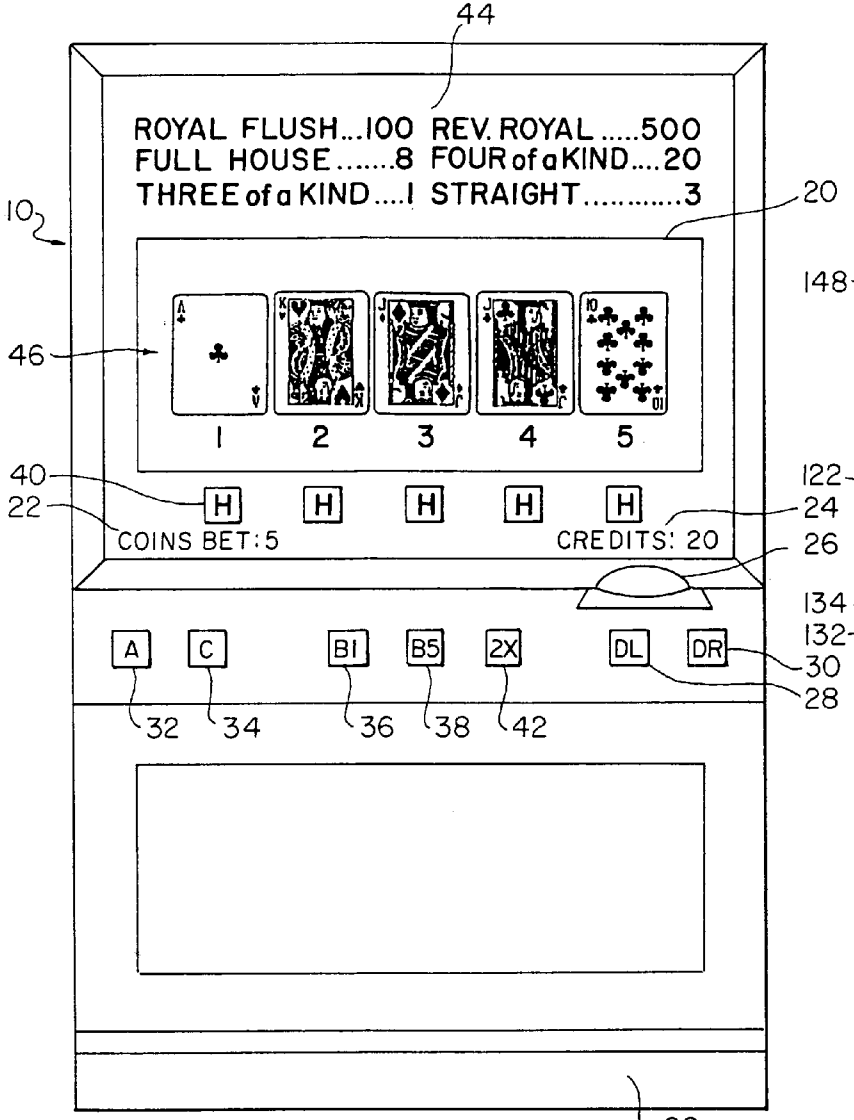

The objects and features of the present invention, which are believed to be novel, are set forth with particularity in the appended claims. The present player-versus-paytable royal card draw poker and royal card stud poker games of the invention, both as to their organization and manner of play, together with further objects and advantages, may best be understood by reference to the following detailed descriptions, taken in connection with the accompanying drawing figures in which:

FIG. 1 shows in a front elevation view an electronic video draw poker gaming machine of the present invention and upon which the royal card draw poker methodology of the invention can be played; and FIG. 2 shows in a front elevation view an electronic video stud poker gaming machine of the present invention and upon which the royal card stud poker methodology of the invention can be played.

DETAILED DESCRIPTIONS OF PREFERRED EMBODIMENTS

The following description is provided to enable any person skilled in the gaming art to organize and use the invention and sets forth the preferred embodiments contemplated for the design and operation of the apparatus and for carrying out the game methodology of the invention. Various modifications of the apparatus and methodology, however, will become readily apparent to those skilled in the gaming art, since the basic principles of the present game methods will have been specifically provided hereinafter as unique methods of playing player-versus-paytable "royal card" five-card video draw poker and "royal card" five-card video stud poker.

1. Description of a First Preferred Embodiment of the "Royal Poker" or "Royal Card Poker" Game of the Invention.

The first preferred version of the game method of the present invention uses an electronic card deck of the 20 royal flush cards (4 10s, 4 jacks, 4 queens, 4 kings and 4 aces) from the four card suits of a standard 52-card poker deck. These 20 cards are electronically shuffled and formed by the apparatus of the invention into a deck of cards hereinafter referred to as the "royal deck of cards." Drawing FIG. 1 shows, in a front elevation view, an electronic video draw poker gaming machine 10 upon which the royal card draw poker game methodology of the invention can be played by an individual player to attain a winning royal card poker hand versus the paytable established for the game.

The FIG. 1 electronic gaming apparatus 10 of the invention includes a video display screen 20 upon which there is displayed a player's initial "royal card" five-card draw poker hand upon game initiation via the deposit of the player's "bet" wager of coins or tokens or charge of coins or tokens against the player's machine bank. For each game the initial five-card hand displayed is by random electronic card selection via the gaming apparatus of the invention from the 20 card "royal card deck of cards". An LED display 22 shows the number of coins or tokens wagered by the player. Another LED display 24 shows the number of coin or token credits remaining in the player's machine bank. A single coin or token entry slot 26 is provided for the reception of the player's initial "bet" wager and follow-up wagering sums. Game initiation is accomplished by the deposit in entry slot 26 of a maximum number of coins or tokens (typically 5), by the deposit in the entry slot 26 of less than the maximum number of coins or tokens followed by actuation of the deal control button 28, by actuation (or repeated actuation) of the bet one "B1" control button 36 followed by actuation of the deal control button 28, or by actuation of the maximum bet "B5" control button 38 which automatically withdraws maximum "bet" coins or tokens from the player's machine bank of coins or tokens.

The example of an initial "royal card" five-card draw poker hand as shown in FIG. 1 is displayed in sequence on the video display screen 20 as royal cards 1 through 5, i.e., ace of clubs, king of hearts, jack of diamonds, jack of clubs and 10 of clubs. Following the deal and display of the initial hand, the player has the option choice of standing on or doubling his or her initial "bet" wager or doubling the "bet" wager via the actuation of the double bet button 42. Of the example initial poker hand on the display screen 20 of the video poker machine 10 of FIG. 1, i.e., the initial dealt five-card hand 46, the player would have the option of standing on the initial "bet" wager or doubling such wager based upon the player's view of the probability of winning by: holding the two jacks and drawing three cards in hopes of obtaining three or four of a kind in jacks; holding the ace, king and 10 and one of jacks and drawing one card in hopes of obtaining a straight; or holding the ace, jack and 10 of clubs and drawing two cards in hopes of obtaining a royal flush in clubs or a reversible royal in clubs. The player's selected option is effected by actuating the appropriate hold buttons H of the control button sequence 40 followed by actuation of draw control button 30 whereby the held cards are maintained and the non-held cards are discarded and replacement cards (randomly selected by the gaming machine from the remaining cards of the royal deck of cards) are machine dealt to the discarded card positions and displayed on the display screen 20.

Following the replacement of discarded cards, the player's new and final "royal card" five-card hand is machine evaluated with respect to the paytable 44 of winning hands for the royal card draw poker video game of the machine. As the result of such machine evaluation, a pay-off is made by the machine to the player's machine credit bank of an appropriate amount of coins or tokens for a winning hand according to the paytable of winning hands 44 as related to the number of coins or tokens wagered by the player. A proposed paytable for the "royal card" five-card draw poker version of the present invention is shown in Paytable II. set forth above.

The "royal card" five-card draw poker machine 10 of the invention, as shown in FIG. 1, also includes an attendant "A" call button 32 and a cashout "C" button 34. The actuation of the cashout button 34 causes gaming coins or tokens to be deposited from a hopper inside the machine (not shown) into a coin tray 60.

2. Description of a Second Preferred Embodiment of the "Royal Poker" or "Royal Card Poker" Game of the Invention.

The second preferred version of the game method of the present invention also uses an electronic card deck of the 20 royal flush cards from the four card suits of a standard 52-card poker deck. These 20 cards are electronically shuffled and formed by the apparatus of the invention into a "royal deck of cards." Drawing FIG. 2 shows, in a front elevation view, an electronic video stud poker gaming machine 100 upon which the royal card stud poker game methodology of the invention can be played by an individual player to attain a winning royal card poker hand versus the paytable established for the game.

The FIG. 2 electronic gaming apparatus 100 of the invention includes a video display screen 120 upon which there is displayed a player's initial "royal card" stud poker hand upon game initiation via the deposit of the player's "bet" wager of coins or tokens or charge of coins or tokens against the player's machine bank of coins or tokens. For each stud poker game the initial hand of cards comprises three royal cards displayed by random electronic card selection via the gaming apparatus of the invention from the 20 card "royal card deck of cards". An LED display 122 shows the number of coins or tokens wagered by the player. Another LED display 124 shows the number of coin or token credits remaining in the player's machine bank. A single coin or token entry slot 126 is provided for the reception of the player's initial "bet" wager and follow-up wagering sums. Game initiation is accomplished by the deposit in the entry slot 126 of a maximum number of coins or tokens (typically 5), by the deposit in the entry slot 126 of less than the maximum number of coins or tokens followed by actuation of the deal control button 128, by actuation (or repeated actuation) of the bet one "B1" control 136 followed by actuation of the deal control button 128, or by actuation of the maximum bet "B5" control button 138 which automatically withdraws maximum "bet" coins or tokens from the player's machine bank of coins or tokens.

The example of an initial "royal card" stud poker hand as shown in FIG. 2 is displayed in sequence on the video display screen 120 as a hand 146 of face-up royal cards 1, 3 and 5, i.e., ace of clubs (card 1), jack of clubs (card 3) and 10 of clubs (card 5). Two face-down cards 148 are dealt in card positions 2 and 4. Following the deal and display of the initial partial hand, the player has the option choice of standing on or doubling his or her initial "bet" wager or doubling the initial "bet" wager via the actuation of the double bet "2X" button 140. With respect to the initial three face-up cards of the partial poker hand 146 on the display screen 120 of the video poker machine 100, the player would have the option of standing on the initial "bet" wager or doubling such wager based upon the player's view of the probability of obtaining a winning hand by the turn-up of favorable cards comprising the first and second face-down cards, i.e., cards 2 and 4 (respectively) of the face-down cards 148.

Where the "royal card" stud poker player elects to stand on his or her original "bet" wager, the deal control button 128 is actuated and the machine turns face-up cards 2 and 4 to complete the stud poker hand followed by machine evaluation of the hand with respect to the paytable 144 of winning hands for the royal card stud poker video game of the machine 100. As the result of such machine evaluation, a pay-off is made by the machine to the player's machine credit bank of an appropriate amount of coins or tokens for a winning hand according to the paytable of winning hands 144 as related to the number of coins or tokens wagered by the player.

Where the "royal card" stud poker player elects to double his or her original "bet" wager the player actuates the double bet "2X" button 140 whereupon the machine registers in LED display 122 the double bet amount and the machine debits the player's machine credit bank the amount of the double bet and charges such debit amount against the player's machine credit bank as shown in LED display 124. The player then actuates the "T1" card turn button 150 whereupon the video machine 100 turns up for display the face-down card 2 and the player again evaluates the then four face-up cards of the hand and assesses the probability of obtaining a winning hand when the face-down card 4 is turned up. If the player elects to triple his or her original "bet" wager the player actuates the triple bet "3X" button 142 whereupon the machine registers in LED display 122 the triple bet amount and the machine debits the player's machine credit bank the amount of the triple bet and charges such debit amount against the player's machine credit bank as shown in LED display 124.

If the player elects to not triple his or her "bet" wager the "T2" card turn control button 152 is actuated and the machine thereupon turns up for display the face-down card 4 to complete the stud poker hand followed by machine evaluation of the hand with respect to the paytable 144 of winning hands for the royal card stud poker video game machine 100 and pay-off of an appropriate amount of coins or tokens for a winning hand according to the paytable as related to the double bet wagered by the player. Where the player has elected to triple his or her original "bet" wager, upon actuation of the triple bet "3X" button 142 the electronic royal card stud poker video machine 100 of the invention turns up the face-down card 4 for display. The machine 100 thereupon evaluates the completed hand with respect to the paytable 144 of winning hands and the machine pays off an appropriate amount of coins or tokens for a winning hand according to the paytable as related to the total number of coins or tokens wagered by the player.

The "royal card" five-card stud poker machine of the invention, as shown in FIG. 2, also includes an attendant "A" call button 132 and a cashout "C" button 134. The actuation of the cashout button 134 causes gaming coins or tokens to be deposited from a hopper inside the machine (not shown) into a coin tray 160.

As previously indicated, for the "royal card" five-card draw poker game version and the "royal card" five-card stud poker game version and apparatus described above the paytable may comprise Paytable II. set forth above. Variations in the paytable may occur where a wild card is incorporated in the "royal deck of cards". Other variations in the method and apparatus of the royal five-card games of the invention may relate to the manner in which the cards are dealt and positioned with respect to the electronic gaming machines of the invention.

It is also to be understood that means may be provided in royal card video poker game machine apparatus of the invention to permit the player to elect whether the machine will operate and display cards in accordance with a royal card five-card draw poker game or to operate and display cards in accordance with a royal card five-card stud poker game.

Those skilled in the gaming art will appreciate that various adaptations and modifications of the above described preferred method and apparatus embodiments of the present invention can be configured without departing from the scope and spirit of the invention. Therefore, it is to be understood that, within the scope of the appended claims, the invention may be practiced other than as specifically described herein.

What is claimed is:

1. A method of playing, via an electronic video game machine, a player-versus-paytable five-card poker game utilizing the 20 royal cards of the four card suits of a standard 52-card poker deck as a royal deck of cards with player pay-off awards based upon predetermined amounts related to a paytable of winning five-card hands, said method comprising:

a) accepting from a game player an initial "bet" wager;

b) dealing said player for display on a video screen of said game machine a royal card five-card poker hand from said royal deck of cards with up to two cards of said hand dealt face-down and out of view to said player and with the other cards of said hand dealt face-up and to the view of said player;

c) permitting the player, after viewing his or her face-up dealt cards, to either stand on said initial "bet" wager or double said initial "bet" wager;

d) turning up and displaying on said video screen said face-down cards, if any, to said player to complete a royal card five-card poker hand or permitting said player to discard one or more of said face-up cards where the five-card hand as dealt comprises five face-up cards and exchanging the discarded cards for new cards from said royal deck of cards to complete a royal card five-card poker hand; and e) game machine evaluating of the player's completed royal card hand to determine whether or not said hand comprises a winning hand in accordance with said paytable of winning five-card hands with game machine pay-off to the player for a winning hand.

2. The method of claim 1 wherein the 20 card royal deck of cards utilized in said royal card five-card poker game has added thereto a wild card for use by the player in his or her completed royal card hand.

3. The method of claim 1 wherein said player-versus-paytable five-card poker game is a draw poker game in which the game player is initially dealt a royal card five-card poker hand from said royal deck of cards with all cards of the hand dealt face-up and to the view of the player and the player is permitted to discard one or more of said face-up cards and to exchange the discarded cards for new cards from said royal card deck of cards to complete a royal card five-card poker hand for game machine evaluation and determination of whether or not said completed hand comprises a winning hand in accordance with said paytable of winning five-card hands.

4. The method of claim 1 wherein said player-versus-paytable five-card poker game is a stud poker game in which the game player is initially dealt a royal card five-card poker hand from said royal deck of cards with up to two cards of said hand dealt face-down and out of view to said player and with the other cards of said hand dealt face-up and to the view of said player whereupon after said face-down cards are turned up to complete a royal card five-card poker hand for game machine evaluation and determination of whether or not said completed hand comprises a winning hand in accordance with said paytable of winning five-card hands.

5. The method of claim 1 wherein the paytable schedule is as follows:

| | | | | | |
|---|---|---|---|---|---|
| REVERSIBLE ROYAL FLUSH | 500 | 1000 | 1500 | 2000 | 2500 |
| ROYAL FLUSH | 100 | 200 | 300 | 400 | 500 |
| FOUR OF A KIND | 20 | 40 | 60 | 80 | 100 |
| FULL HOUSE | 8 | 16 | 24 | 32 | 40 |
| STRAIGHT | 3 | 6 | 9 | 12 | 15 |
| THREE OF A KIND | 1 | 2 | 3 | 4 | 5. |

6. Apparatus for playing a player-versus-paytable five-card poker game on an electronic video gaming machine utilizing the 20 royal cards of the four card suits of a standard 52-card poker deck as a royal deck of cards with player pay-off awards based upon predetermined amounts related to a paytable of winning five-card hands, said apparatus comprising:

a) means for accepting from a game player an initial "bet" wager;

b) means for displaying to the player on a video screen of said gaming machine a royal card five-card poker hand from said royal deck of cards with up to two cards of said hand dealt face-down and out of view to said player and with the other cards of said hand dealt face-up and to the view of said player;

c) wager means activated by the player, after viewing his or her face-up dealt cards, to either stand on said initial "bet" wager or to double said initial "bet" wager;

d) card manipulation means activated by the player to turn up and display on said video screen said face-down cards, if any, to complete a final royal card five-card poker hand or to discard one or more of said face-up cards where the five-card hand as dealt comprises five face-up cards and exchanging the discarded cards for new cards from said royal deck of cards to complete a final royal card five-card poker hand;

e) means for evaluating the player's final royal card five-card hand to determine whether or not said final hand comprises a winning hand in accordance with said paytable of winning five-card hands; and f) means for awarding to the player a predetermined amount based upon the value of said final royal card five-card poker hand with respect to said paytable.

7. The apparatus of claim 6 for playing a player-versus-paytable five-card poker game wherein the game is a five-card draw poker game and wherein the means for displaying to the player on a video screen of said gaming machine a royal card five-card poker hand from said royal deck of cards displays the five cards of said hand dealt face-up and to the view of the player, and the card manipulation means includes means to discard one or more of said face-up cards and to exchange said discarded cards for new cards to complete a final royal card five-card draw poker hand.

8. The apparatus of claim 6 for playing a player-versus-paytable five-card poker game wherein the game is a five-card stud poker game and wherein the means for displaying to the player on the video screen of said gaming machine a royal card five-card poker hand from said royal deck of cards displays up to two cards of said hand dealt face-down and out of view to said player and with the other cards of said hand dealt face-up and to the view of said player, and the card manipulation means includes means to turn up and display on said video screen said face-down cards to complete a final royal card five-card stud poker hand.

9. The apparatus of claim 6 for playing a player-versus-paytable five-card poker game wherein the means for accepting from a game player an initial "bet" wager includes means for wagering at least one coin or token to activate said gaming machine.

10. The apparatus of claim 6 for playing a player-versus-paytable five-card poker game wherein means are provided to permit the player to elect whether the machine will operate and display cards in accordance with a royal card five-card draw poker game or to operate and display cards in accordance with a royal card five-card stud poker game.

* * * * *